US005407327A

United States Patent [19]

Fehlmann

[11] Patent Number: 5,407,327

[45] Date of Patent: Apr. 18, 1995

[54] VANE CELL PUMP

[75] Inventor: Wolfgang Fehlmann, Stuttgart, Germany

[73] Assignee: Robert Bosch GmbH, Stuttgart, Germany

[21] Appl. No.: 177,485

[22] Filed: Jan. 5, 1994

[30] Foreign Application Priority Data

Feb. 4, 1993 [DE] Germany ..... 43 03 115.3

[51] Int. Cl.[6] ..... F01C 1/00

[52] U.S. Cl. ..... 418/267; 418/145

[58] Field of Search ..... 418/145, 266, 267, 268

[56] References Cited

U.S. PATENT DOCUMENTS

| | | | |
|---|---|---|---|
| 1,913,758 | 6/1933 | Hapkins | 418/266 |
| 2,650,573 | 9/1953 | Hickman | 418/267 |
| 2,832,199 | 4/1956 | Adams et al. . | |
| 3,120,154 | 2/1964 | Gilreath | 418/267 |
| 3,535,062 | 10/1970 | Jagger | 418/268 |
| 3,627,456 | 12/1971 | Gerlach | 418/267 |
| 4,792,295 | 12/1988 | Joyce, Sr. | 418/268 |

FOREIGN PATENT DOCUMENTS

| | | | |
|---|---|---|---|
| 0538558 | 6/1955 | Belgium | 418/268 |
| 2271387 | 12/1975 | France | 418/268 |
| 4033455 | 6/1992 | Germany . | |

*Primary Examiner*—Richard A. Bertsch
*Assistant Examiner*—Charles G. Freay
*Attorney, Agent, or Firm*—Edward E. Greigg; Ronald E. Greigg

[57] ABSTRACT

A vane cell pump with a housing ring closed on the face end and with a rotary piston that revolves eccentrically to the inner wall of the housing ring, which rotary piston encloses at least one supply chamber with the inner wall of the housing ring and with at least one spring-loaded vane that is held radially displaceably in order to limit the supply pressure at a given rpm, at least one pressure impingement face that is acted upon by the supply pressure in the supply chamber is formed on the vane in such a way that by the supply pressure, a radial force oriented to the vane counter to the compression spring is produced that at a predetermined supply pressure is greater than the total of the force of the compression spring and the centrifugal force acting on the vane.

5 Claims, 4 Drawing Sheets

VANE CELL PUMP

BACKGROUND OF THE INVENTION

The invention is based on a vane cell pump, particularly for feeding fuel to fuel injection pumps of internal combustion engines as defined hereinafter.

Such vane cell pumps, of the kind known for instance from U.S. Pat. No. 2,832,199 or German Patent Disclosure DE 40 33 455 A1, are used, among other purposes, also in injection pumps for internal combustion engines, in order to fill the fuel supply chamber of the injection pump with fuel from the fuel tank at supply pressure. From the fuel supply chamber, a metered quantity of fuel is then withdrawn from the injection pump and delivered at very high injection pressure to the various injection nozzles. The vane cell pump is generally integrated into the injection pump and is driven by its drive shaft. Since the drive shaft of the fuel injection pump rotates synchronously with the rpm of the engine, which varies over wide ranges, the vane cell pump produces a variably high feed pressure depending on the rpm. Since the fuel metering in the fuel injection pump is substantially facilitated if the fuel in the fuel supply chamber is at a constant pressure, in the known vane cell pump the fuel supply chamber is connected via a pressure regulating valve to a fuel return line leading to the fuel tank, so that the pressure in the fuel supply chamber is kept at a constant pressure level, regardless of the rpm of the vane cell pump.

OBJECT AND SUMMARY OF THE INVENTION

The vane cell pump according to the invention has the advantage, by comparison, that at the desirably predetermined supply pressure of the vane cell pump, the at least one vane deflects away from the stroke curve and thus the feed pressure is limited beyond a certain rpm of the vane cell pump. When a vane cell pump of this kind is used in injection pumps, the pressure regulating valve can then be dispensed with, since the vane cell pump itself is capable of keeping the pressure in the fuel supply chamber constant. With the omission of the pressure regulating valve, the losses of the injection pump at high rpm and during starting are also reduced. Additional machining of the pump housing to create a connecting bore for the fuel return line becomes unnecessary.

Advantageous further features of and improvements to the vane cell pump disclosed are possible by means of the provisions recited herein.

In a preferred embodiment of the invention, the pressure impingement area of the vane is achieved in a structurally simple way by providing that the vane have at least one strut on its face end resting on the stroke curve, which strut extends over the entire vane width viewed in the axial direction of the rotary piston and whose dimension in the rotary direction is reduced compared with the corresponding vane dimension. With the strut, the vane rests on the stroke curve under the pressure of the compression spring, and the pressure impingement face is formed by the end face of the vane that remains at the bottom of the strut.

In a preferred embodiment of the invention, the vane is guided displaceably in a shaft, and the compression spring is supported between the shaft bottom and the vane. The shaft may be embodied either in the rotary piston, in which case the stroke curve is located on the inner wall of the housing ring, or in the housing ring, in which case the stroke curve is formed by the outer jacket of the rotary piston. The vane has a longitudinally continuous bore which opens both into the shaft bottom and on the vane end toward the stroke curve, and as a result the vane is pressure-balanced.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
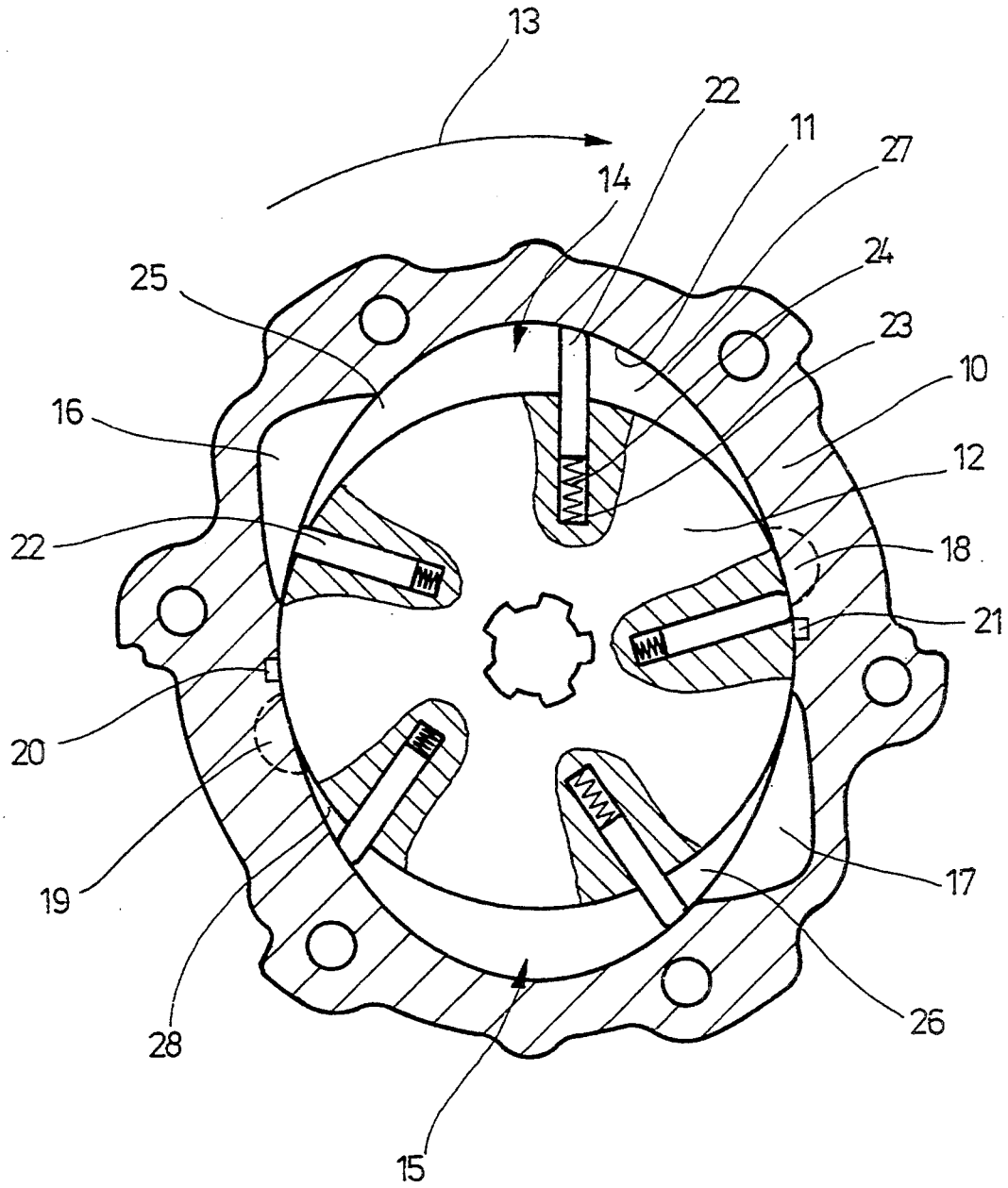
FIG. 1 is a schematic cross section through a dual-flow vane cell pump.

The vane cell pump, shown schematically in cross section in FIG. 1, for feeding fuel in a fuel injection pump in internal combustion engines has a housing ring 10 closed at its face ends, and a rotary piston 12 revolving in the housing ring 10 eccentrically with respect to the inner wall 11 thereof. In the exemplary embodiment shown, the rotary piston 12 is rotatably supported coaxially with the housing ring 10 and is driven by a drive shaft, not shown here. The eccentricity between the rotary piston 12 and the inner wall 11 of the housing ring 10 is achieved by an approximately elliptical course of the inner wall 11, so that two supply channels 14, 15 are created between the housing ring 10 and the rotary piston 12 rotating in the direction of rotation 13, the beginning of which chambers, in terms of the rotary direction 13, communicates with inlets 16 and 17 and whose end communicates with outlets 18 and 19, respectively. A respective pump inlet valve and pump outlet valve are typically disposed at the inlets 16 and 17 and outlets 18 and 19, but for the sake of simplicity these valves are not shown here. The two supply chambers 14, 15 are identically embodied and have a radial width that varies over the circumference; in the direction of rotation 13 of the rotary piston 12, this width increases from the beginning to the middle of the chamber and decreases again from the middle to the end of the chamber. The radial width of the supply chambers 14, 15 is defined by the eccentricity of the inner wall 11 of the housing ring 10, which eccentricity has a trochoid-like course with respect to the rotor shaft in the region of the supply chambers 14, 15. The two supply chambers 14, 15 are separated from one another in pressure-tight fashion by two sealing strips 20, 21, which are placed in corresponding longitudinal grooves in the housing 10 and which rest on the rotary piston 12 in the region of the smallest gap between the housing ring 10 and this rotary piston.

The rotary piston 12 has a total of five vanes 22, which rest slidingly in axially continuous radial slits 23 that extend parallel to the rotary piston axis and radially as far as the circumference of the rotary piston 12. The radially extending axes of the radial slits 23 are transversely shifted by a constant amount out of the rotor axis, so that their intersections form a pentagon that is concentric with the rotor axis. Supported between the bottom of the radial slits 23 and the end of the vanes 22 toward them is a compression spring 24, which presses the vane 22, by its end remote from it, against the inner wall 11 of the housing ring 10. When the rotary piston 12 is in rotation, the vanes 22 are thus made to execute a reciprocating motion, in accordance with the embodiment of the inner wall 11, which forms the so-called stroke curve for the vanes 22. In the rotation of the rotary piston 12, the five vanes 22 divide the two supply chambers 14, 15 into suction cells 25, 26 that communicate with the inlets 16, 17, and compression cells 27, 28 that communicate with the outlets 18, 19. The suction cells 25, 26 and compression cells 27, 28 vary in volume upon rotation of the rotary piston 12 in the direction of rotation 13, and as a result fuel is pumped from the inlets 16, 17 to the outlets 18, 19. Although not shown here, the inlets 16, 17 begin at a common inlet conduit, and the outlets 18, 19 are combined into one joint outlet conduit.

Figure 2:
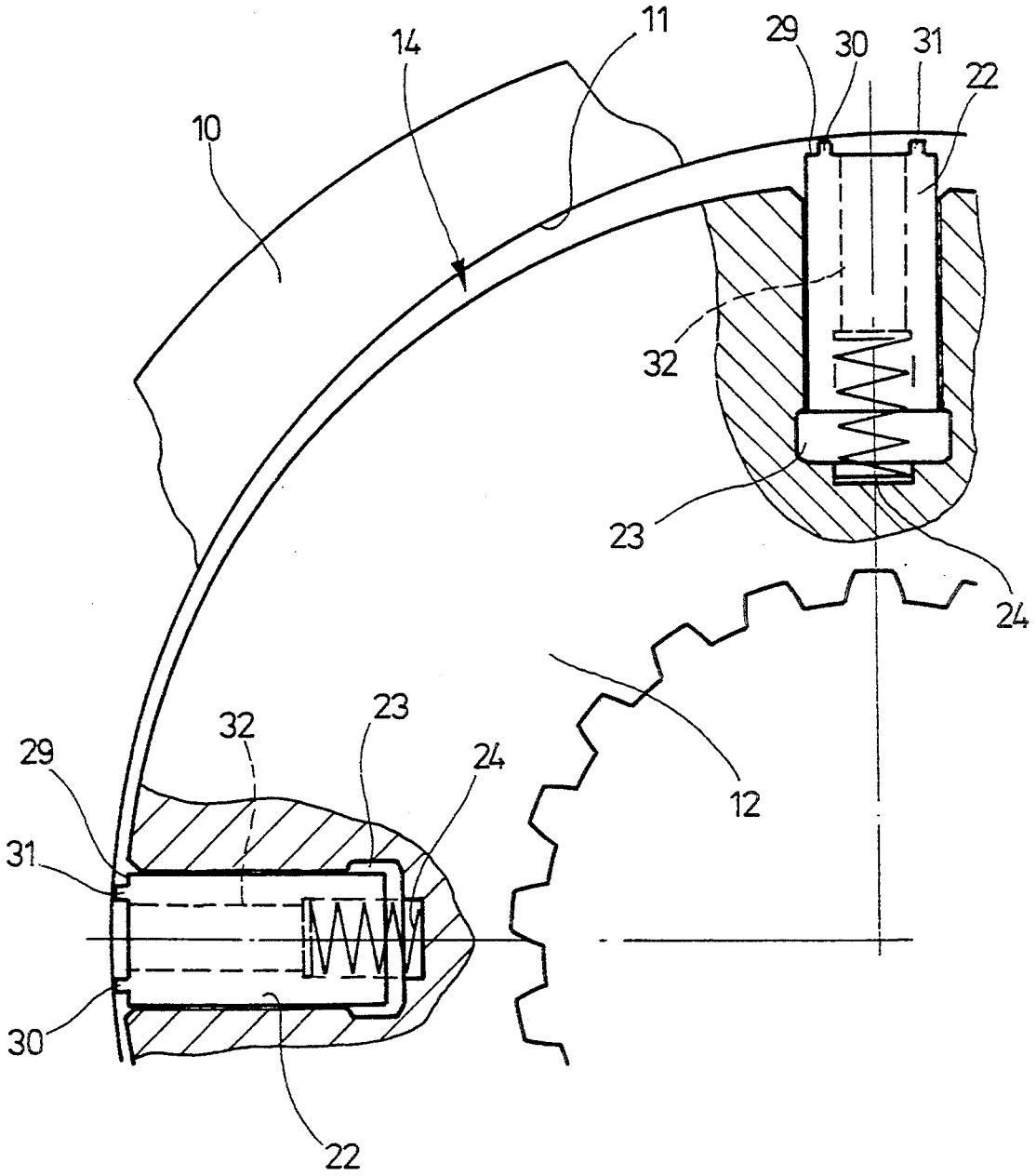
FIG. 2 is an enlarged view of a detail of the vane cell pump of FIG. 1.
Figure 4:
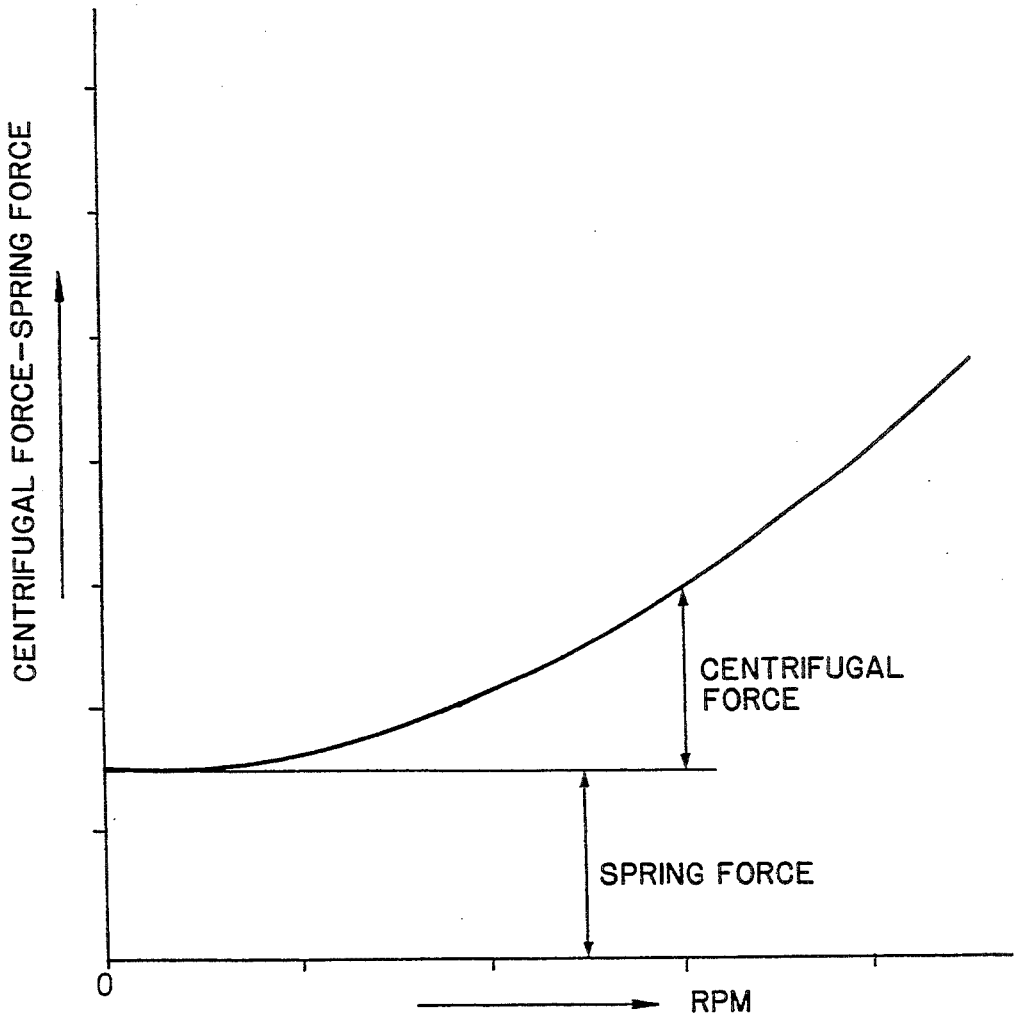
FIG. 4 is a diagram of the total force, acting on the vane in the radial direction, as a function of the rpm.

As can be seen from the enlarged detail of the vane cell pump in FIG. 2, a pressure impingement face 29 is formed on each vane 22 and is acted upon by the pressure in the supply chamber 14, 15. The pressure impingement face 29 should be dimensioned such that by means of the feed pressure, a radial force is generated that is oriented toward the vane 22 counter to the compression spring 24 and that for a given feed pressure is greater than the total of the force of the compression spring 24 and the centrifugal force acting on the vane 22. A force diagram as a function of the rpm of the rotary piston 12 is shown in FIG. 4. While the spring force of the compression spring 24 is constant over the rpm range, the centrifugal force acting upon the vane 22 increases disproportionately with increasing rpm. If the radial force acting on the vane 22 in the opposite direction, that is, in the displacement direction into the rotary piston 12, is greater than this total force, then the vane 22 lifts away from its stroke curve on the inner wall 11 of the housing ring 10, and the pressure in the compression cells 27, 28 cannot be increased any further.

Figure 3:
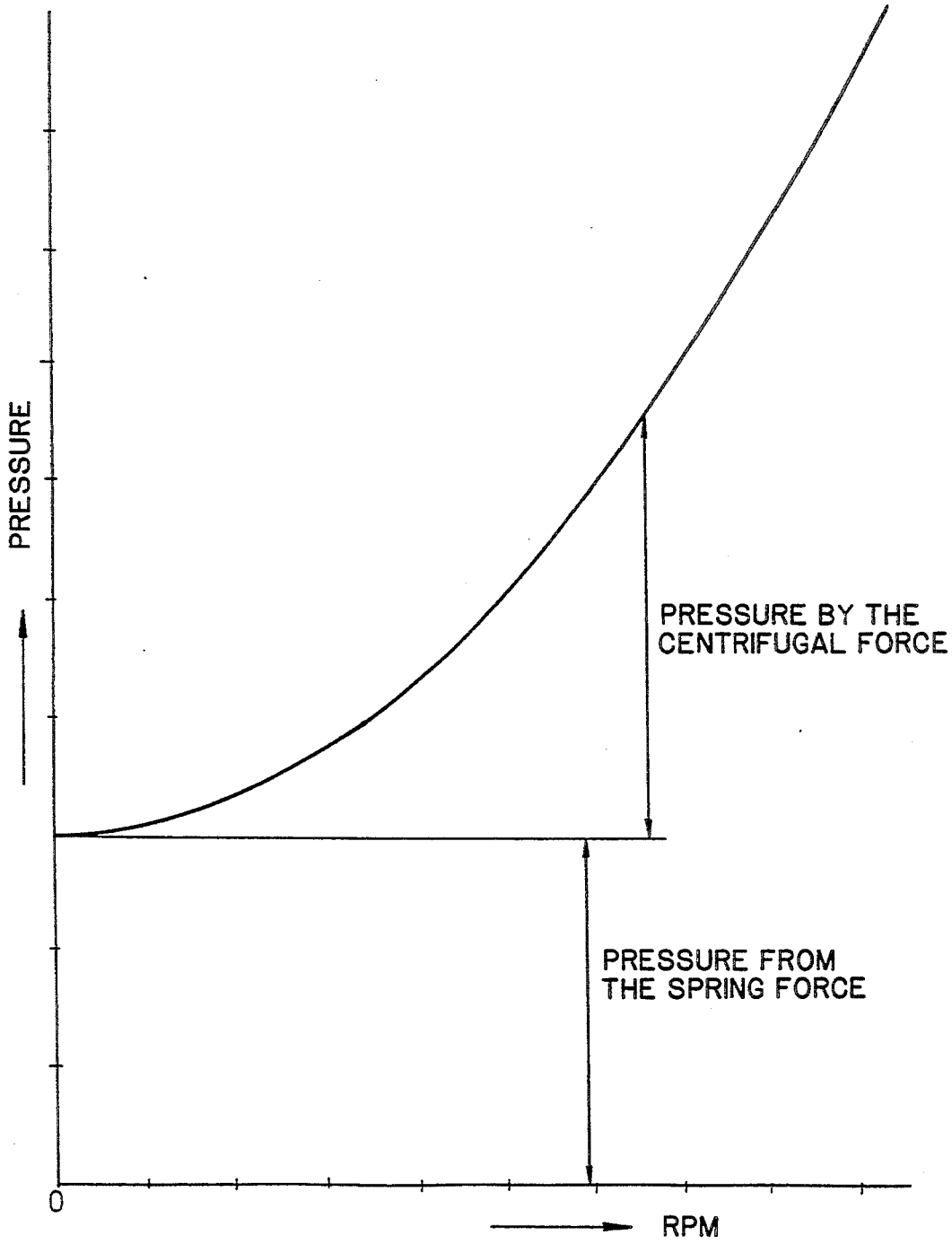
FIG. 3 is a diagram for the feed pressure as a function of the rpm.

In FIG. 3, the pressure acting on the vane 22, resulting from the spring force of the compression spring 24, and the centrifugal force are shown as a function of the rpm. The pressure impingement face 29 should now be designed such that for a given desired feed pressure, this pressure compensates for the increase in pressure from the centrifugal force on the vane 22 to an extent such that the vane lifts away from the inner wall 11 of the housing 10 and thus the feed pressure does not rise any further.

For the sake of simple realization of the pressure impingement face 29, two struts 30, 31 are formed on the stroke curve-side face end of each vane 22; these struts are spaced apart from one another, as viewed in the direction of rotation 13 of the rotary piston 12. Each strut 30, 31 extends over the entire vane width, as viewed in the axial direction of the rotary piston 12, and is severely reduced in its dimensions, viewed in the direction of rotation 13, compared with the corresponding vane dimensions, so that the vane 22 with the struts 30, 31 rests on the stroke curve or inner wall 11 of the housing ring 10, and the pressure impingement face 29 rests at a distance from the inner wall on the bottom of the strut. While the struts 30, 31 each seal off the suction cells 25, 26 and the compression cells 27, 28 from one another, the pressure impingement face 29 can be acted upon by the pressure in the compression cells 27, 28. For pressure equalization at the vane 22, each vane 22 is provided with a longitudinally continuous bore 32, which opens on the one hand out into the bottom of the radial slits 23 and on the other into the end toward the stroke curve of the vanes 22, or in other words at the pressure impingement face 29.

The invention is not limited to the exemplary embodiment described above. For instance, the eccentricity between the revolving rotary piston 12 and the inner wall 11 of the housing ring 10 may also be achieved by providing that the inner wall has a circular course and the rotary piston is eccentrically supported in the housing ring 10. At least one vane is then radially displaceably guided in the housing ring 10 and is pressed by the compression spring against the outer face of the rotary piston. One such version of the vane cell pump is described in DE 38 05 517 A1, for instance.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A vane cell pump for supplying fuel in fuel injection pumps of internal combustion engines, comprising a housing ring (10) having closed face ends and a rotary piston (12) that revolves relative to an eccentric inner wall (11) of the housing ring, said piston includes at least one radially displaceably retained vane (22), which in combination with the inner wall (11) encloses at least one supply chamber (14, 15) with a chamber volume that shifts upon rotary piston rotation and thereby supplies fluid from at least one inlet (16, 17) in said housing ring to at least one outlet (18, 19) in said housing ring, and at least one compression spring (24) that acts on the at least one vane (22) in a displacement direction toward said inner wall (11) and presses a face end of the at least one vane (22) against a stroke curve that is embodied on the inner wall (11) of the housing ring (10), at least one pressure impingement face (29) is embodied on a face end of said vane (22) that is acted upon by supply pressure in the supply chamber (14, 15), such that by the supply pressure, a radial force oriented counter to the compression spring (24) and acting on the vane (22) is produced that at a predetermined supply pressure is greater than the total of the force of the compression spring (24) and any centrifugal force acting on the vane (22).

2. A pump as defined by claim 1, in which the face end of the vane (22) has at least one strut (30, 31) extending over an entire width of the vane viewed in the axial direction of the rotary piston (12) which rests on the stroke curve (11), said at least one strut forms an end of the vane (22) that rests on the stroke curve (11) and said at least one strut is reduced in a dimension viewed in the rotational direction compared with the face end of a corresponding vane dimension, and that the pressure impingement face (29) is embodied by the end face of the vane (22) extending at a bottom of the at least one strut.

3. A pump as defined by claim 2, in which the vane (22) has two axial struts (30, 31) disposed spaced apart from one another in the rotational direction, which are preferably disposed symmetrically with respect to a center of the vane.

4. A pump as defined by claim 1, in which the at least one vane (22) is displaceably guided in a radial slit (23)

that includes a slit bottom; that the compression spring (24) is supported between the slit bottom and the vane (22); and that the vane (22) has an equalization bore (32) that opens out both into the slit bottom and into the face end of the vane toward the inner wall of the housing ring.

5. A pump as defined by claim 1, in which the rotary piston (12) is cylindrically embodied, includes an outer wall, and is rotatably supported coaxially with the housing ring (10) and also carries the radial slits (23) of the rotary piston; that a stroke curve is formed on the inner wall (11) of the housing ring (10), which inner wall extends approximately elliptically such that two supply chambers (14, 15) are formed between the outer wall of the rotary piston (12) and the inner wall (11) of the housing ring (10); that the vanes (22) are distributed over a circumference of the rotary piston such that the vanes divide each of the supply chambers (14, 15) into one suction cell (25, 26) and one compression cell each (27–28), with cell volumes that vary continuously upon rotation of the rotary piston (12); and that viewed in a rotational direction (13) of the rotary piston (12), the beginning end of the suction cell begins to communicate with the inlet (16, 17) and the compression cell (27–28) ends with communication with the outlet (18, 19).

* * * * *